US009010748B2

(12) United States Patent
Hamasaki

(10) Patent No.: US 9,010,748 B2
(45) Date of Patent: Apr. 21, 2015

(54) SHEET FEEDING APPARATUS AND IMAGE FORMING APPARATUS

(71) Applicant: Canon Kabushiki Kaisha, Tokyo (JP)

(72) Inventor: Ryuji Hamasaki, Zhongshan (CN)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/937,384

(22) Filed: Jul. 9, 2013

(65) Prior Publication Data

US 2014/0021680 A1 Jan. 23, 2014

(30) Foreign Application Priority Data

Jul. 18, 2012 (JP) ..... 2012-159459

(51) Int. Cl.
*B65H 1/00* (2006.01)
*A47B 88/00* (2006.01)
*B65H 1/26* (2006.01)

(52) U.S. Cl.
CPC ..... *B65H 1/00* (2013.01); *B65H 1/266* (2013.01); *B65H 2402/32* (2013.01); *B65H 2402/64* (2013.01); *B65H 2405/114* (2013.01); *B65H 2405/15* (2013.01); *B65H 2405/32* (2013.01); *B65H 2801/06* (2013.01)

(58) Field of Classification Search
CPC ..... A47B 88/16
USPC ..... 271/162, 164, 145; 399/393; 312/334.44–334.47
See application file for complete search history.

(56) References Cited

U.S. PATENT DOCUMENTS

| | | | | |
|---|---|---|---|---|
| 3,722,975 | A * | 3/1973 | Taylor | 312/334.44 |
| 7,931,267 | B2 * | 4/2011 | Kajiyama | 271/164 |
| 7,967,287 | B2 | 6/2011 | Hamasaki et al. | |
| 8,210,524 | B2 * | 7/2012 | Uchida | 271/164 |
| 2008/0111295 | A1 * | 5/2008 | Tanaka et al. | 271/164 |
| 2010/0133743 | A1 | 6/2010 | Hamasaki et al. | |
| 2011/0221121 | A1 | 9/2011 | Hamasaki et al. | |

FOREIGN PATENT DOCUMENTS

| | | | |
|---|---|---|---|
| GB | 2242350 A | * | 10/1991 |
| JP | 2000013039 A | * | 1/2000 |
| JP | 2006-346156 A | | 12/2006 |
| JP | 2007-161448 A | | 6/2007 |

* cited by examiner

*Primary Examiner* — Luis A Gonzalez
(74) *Attorney, Agent, or Firm* — Fitzpatrick, Cella, Harper & Scinto

(57) ABSTRACT

A sheet feeding apparatus of the present invention includes a feeding apparatus body, a storage case body, a storage case caster which movably supports the storage case body in a pull-out direction, and a drop-out preventing units having a pull-out stopper which regulates a pull-out position of the storage case body from the feeding apparatus body, a storage case stopper which is provided at a rear end in the pull-out direction of the storage case body, an upper-face rail portion which is formed in the feeding apparatus body to guide the storage case stopper into the pull-out direction, and a drop-out stopper which is engaged with the storage case stopper at the rear end in the pull-out direction compared to the pull-out stopper to regulate a movement of the storage case body toward the pull-out direction, if the storage case body is rotated with a predetermined angle or more.

18 Claims, 20 Drawing Sheets

SHEET FEEDING APPARATUS AND IMAGE FORMING APPARATUS

BACKGROUND OF THE INVENTION

1. Field of the Invention

The present invention relates to a sheet feeding apparatus for feeding a sheet and an image forming apparatus provided with the sheet feeding apparatus.

2. Description of the Related Art

Generally, an image forming apparatus such as a copying machine, a laser beam printer, or a facsimile is provided with a sheet feeding apparatus which automatically feeds a sheet into an image forming portion one by one. The sheet feeding apparatus is provided with a sheet storage case which stores a feeding sheet and the sheet storage case is movable onto a rail installed on a feeding apparatus body so as to pull out it when a user replenishes the sheet. Further, a pull-out stopper is provided on the rail to regulate a pull-out degree of the sheet storage case, and thus it can prevent the sheet storage case from being easily fallen off at the time of being pulled out by the user.

In the image forming apparatus, recently, there is a growing need for the sheet feeding apparatus having the sheet storage case capable of storing the sheets in large numbers so as to reduce a user's burden of loading the sheets. In a case of providing the high-capacity sheet storage case, since the weight of sheets increases, the strength of the sheet storage case itself is required. Therefore, the weight of the sheet storage case itself also tends to increase. For this reason, when the sheet storage case is pulled out and the weight of the sheet storage case is supported by the rail, an excessive force (moment) is applied to the rail, and thus deformation or breakage of the rail may be generated.

With respect to this, the sheet feeding apparatus has been proposed that supports the weight of the sheet storage case by allowing a storage case caster provided on a bottom of the sheet storage case to come in contact with a floor when the sheet storage case is pulled out (see Japanese Patent Laid-Open Nos. 2007-161448 and 2006-346156).

However, existing sheet feeding apparatuses may not support the sheet storage case when the image forming apparatus is installed on a place, for example, a stepped place or a desk where the storage case caster comes in not contact with the floor at the time of pulling out the sheet storage case. Here, the weight of the sheet storage case when the sheet storage case is pulled out is generally supported by an interlocked portion of the rail and the sheet storage case in the feeding apparatus body. Accordingly, in order to support the high-capacity sheet storage case, the sheet feeding apparatus capable of increasing the strength by a multistage rail is disclosed in Japanese Patent Laid-Open No. 2006-346156, but there have been problems that the configuration of the rail becomes complicated and the cost also becomes high.

Accordingly, the present invention provides the sheet feeding apparatus capable of supporting the sheet storage case with a simple configuration and the image forming apparatus provided with the sheet feeding apparatus.

SUMMARY OF THE INVENTION

A sheet feeding apparatus according to the present invention includes an apparatus body, a sheet storage case capable of pulling out from the apparatus body, a rotating supporting member which movably supports the sheet storage case in a pull-out direction when the sheet storage case is pulled out from the apparatus body, and a drop-out preventing unit having a first stopper which regulates a pull-out position of the sheet storage case from the apparatus body when the sheet storage case is pulled out from the apparatus body, an engaging portion which is formed at a rear end of the pull-out direction of the sheet storage case, a guiding portion which is formed in the apparatus body to guide the engaging portion into the pull-out direction, and a second stopper which is engaged with the engaging portion at the rear end of the pull-out direction from the first stopper to regulate a movement of the sheet storage case toward the pull-out direction, if the sheet storage case is rotated with a predetermined angle or more when the sheet storage case is pulled out from the apparatus body.

According to the present invention, it is possible to support the sheet storage case with the simple configuration by providing the second stopper which stops the sheet storage case at the rear end in the pull-out direction of the first stopper for regulating the pull-out position when the sheet storage case rotates.

Further features of the present invention will become apparent from the following description of exemplary embodiments with reference to the attached drawings.

DESCRIPTION OF THE EMBODIMENTS

Hereinafter, an image forming apparatus including a sheet feeding apparatus according to embodiments of the present invention will be described below with reference to FIGS. 1 to 20. The image forming apparatus according to the embodiments of the present invention is an image forming apparatus, for example, a copying machine, a printer, a facsimile and a multifunction peripheral that includes a sheet feeding apparatus provided with a sheet storage case capable of freely pulling out.

First Embodiment

An image forming apparatus 1 according to a first embodiment of the present invention will be described with reference to FIGS. 1 to 12. First, with regard to an overall configuration of the image forming apparatus 1 according to the first embodiment, it will be described with reference to FIGS. 1 to 5.

Figure 1:
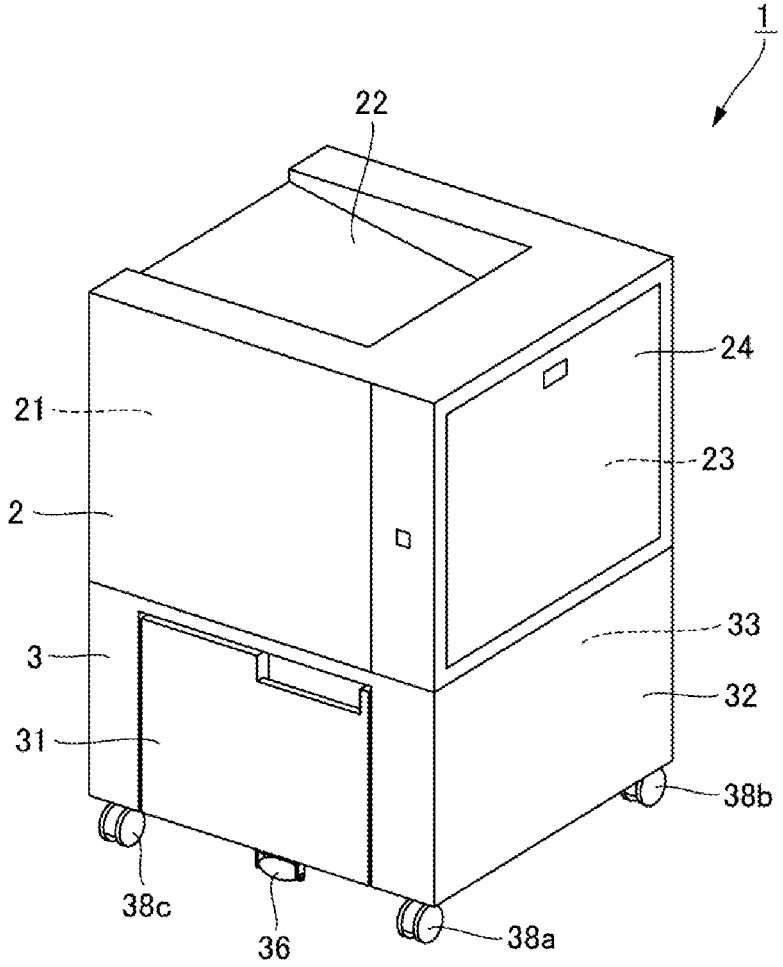
FIG. 1 is a perspective view illustrating an overall configuration of an image forming apparatus according to a first embodiment of the present invention.
Figure 2:
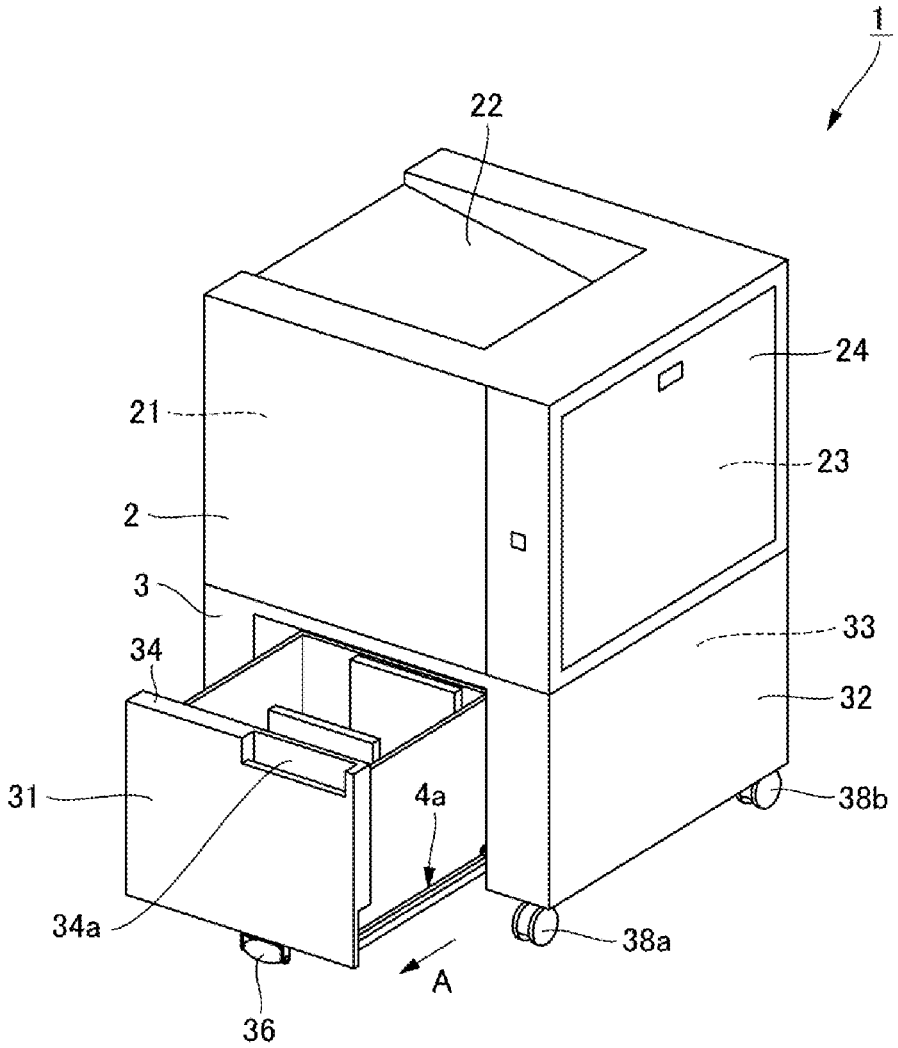
FIG. 2 is a perspective view illustrating a state where a storage case is pulled out from a feeding apparatus body of a sheet feeding apparatus according to the first embodiment.
Figure 3:
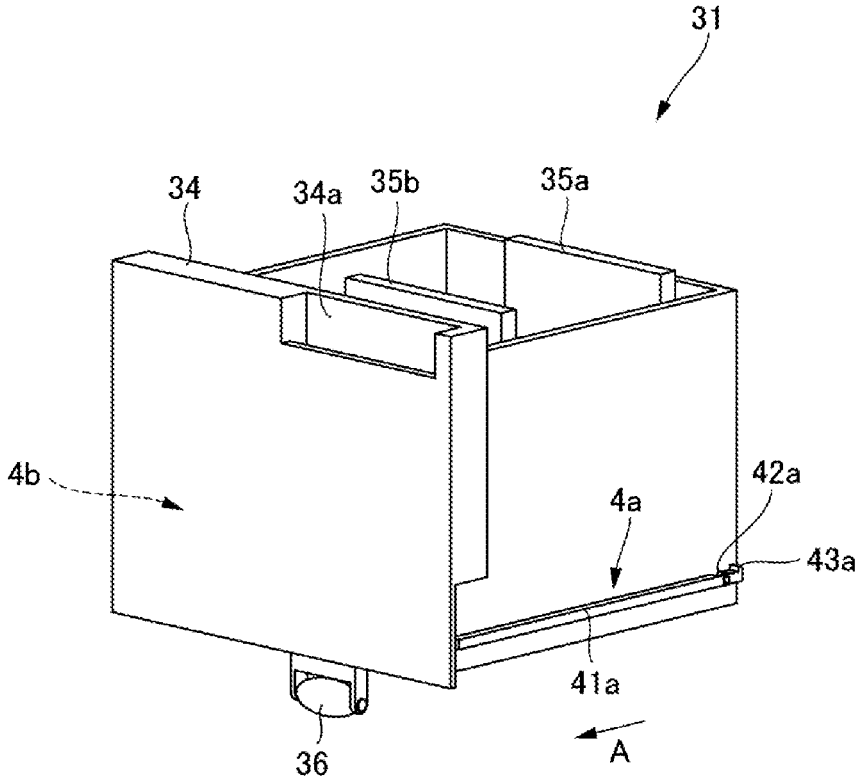
FIG. 3 is a perspective view illustrating the storage case of the sheet feeding apparatus according to the first embodiment.
Figure 4:
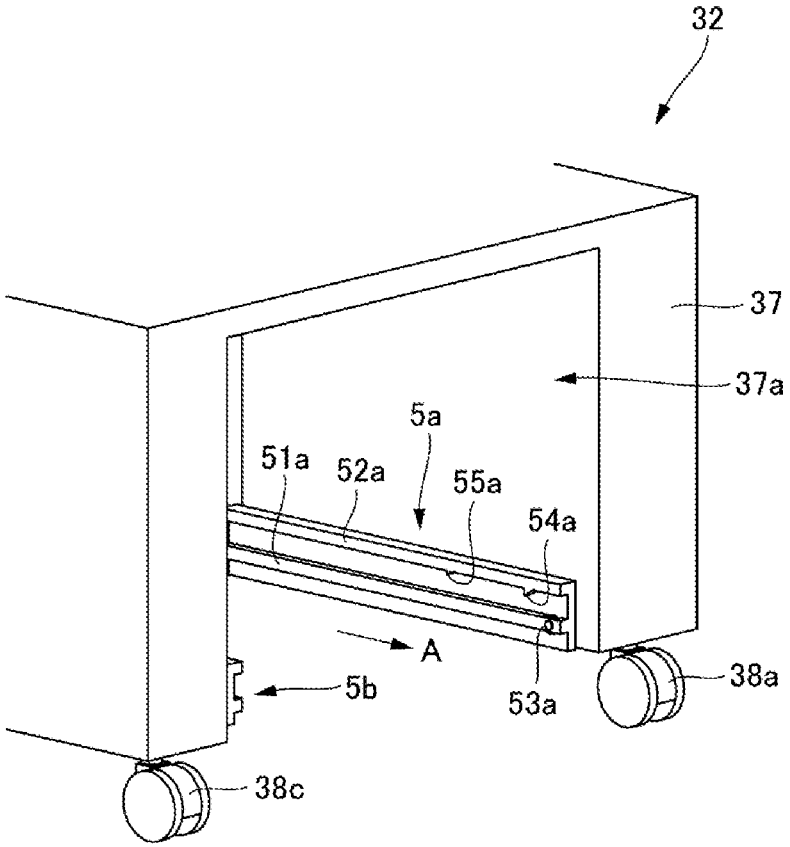
FIG. 4 is a perspective view illustrating the feeding apparatus body of the sheet feeding apparatus according to the first embodiment.
Figure 5:
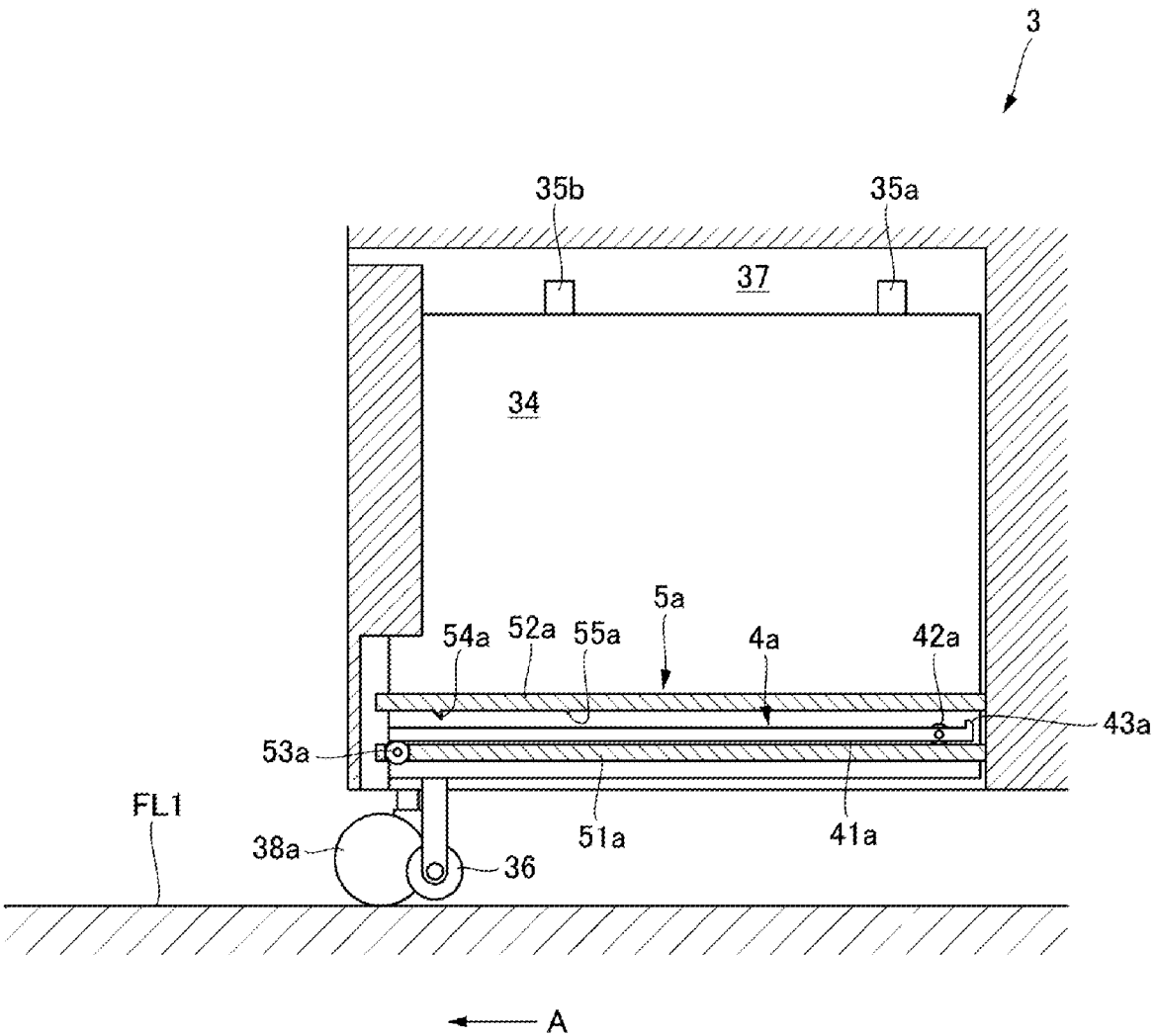
FIG. 5 is a cross-sectional view illustrating a state where the storage case is stored in the feeding apparatus body.

FIG. 1 is a perspective view illustrating the overall configuration of the image forming apparatus 1 according to the first embodiment of the present invention. FIG. 2 is a perspective view illustrating a state where a storage case 31 is pulled out from a feeding apparatus body 32 of a sheet feeding apparatus 3 according to the first embodiment. FIG. 3 is a perspective view illustrating the storage case 31 of the sheet feeding apparatus 3 according to the first embodiment. FIG. 4 is a perspective view illustrating the feeding apparatus body 32 of the sheet feeding apparatus 3 according to the first embodiment. FIG. 5 is a cross-sectional view illustrating a state where the storage case 31 is stored in the feeding apparatus body 32.

As illustrated in FIGS. 1 and 2, the image forming apparatus 1 includes an image forming apparatus body 2 which forms an image on a sheet and a sheet feeding apparatus 3 which feeds the sheet into the image forming apparatus body 2.

The image forming apparatus body 2 includes an image forming portion 21 which forms the image on the sheet S fed from the sheet feeding apparatus 3 and a sheet discharging portion 22 which discharges the sheet on which the image is formed in the image forming portion 21. In addition, the image forming apparatus body 2 includes a sheet conveyance path 23 which is connected to the sheet discharging portion 22 through the image forming portion 21 from the sheet feeding apparatus 3 and an open door 24 which can open the sheet conveyance path 23. Further, a description of detailed configurations of the image forming portion 21 which configures the image forming apparatus body 2 will not be presented.

The sheet feeding apparatus 3 includes a storage case 31 which stores the sheet, a feeding apparatus body 32 which is an apparatus body for storing the storage case 31 to freely pull out it, and a feeding unit 33 which feeds the sheet stored in the storage case 31 toward the image forming portion 21. Further, a description of detailed configurations of the feeding unit 33 will not be presented.

As illustrated in FIG. 3, the storage case 31 includes a storage case body 34 which is a sheet storage case for storing the sheet with a stacked state and a pair of aligning members 35*a* and 35*b* which regulate a width direction perpendicular to a sheet feeding direction of the sheet stored in the storage case body 34. In addition, the storage case 31 includes a storage case caster 36 which is a rotation supporting member provided on a lower face of the storage case body 34 and a pair of storage case rails 4*a* and 4*b* which configure a drop-out preventing unit provided at both lateral faces of the storage case body 34.

The storage case body 34, which is formed to store the sheet with the stacked state, includes a gripping portion 34*a* provided at a leading end of a pull-out direction A (hereinafter, simply referred to as "leading end") on which a user grips when pulling out the storage case 31. The pair of aligning members 35*a* and 35*b* is provided inside the storage case body 34 to regulate the sheets, which are stacked in the storage case body 34, with an aligned state in the width direction. The storage case caster 36 is provided on the bottom of the leading end of the storage case body 34 to movably support a weight of the storage case body 34 at the leading end by coming in contact with a floor FL when the storage case body 34 is pulled out by the user.

The pair of storage case rails 4*a* and 4*b* is symmetrically installed on both lateral faces perpendicular to the pull-out direction A of the storage case body 34 so as to be approximately parallel with the pull-out direction A (horizontal direction). Moreover, since the storage case rail 4*a* and the storage case rail 4*b* have the same configuration, the storage case rail 4*a* installed on one lateral face of the storage case body 34 is described and the storage case rail 4*b* will not be described as denoted by "b" instead of a tag "a".

The storage case rail 4*a* includes a storage case rail body 41*a* which extends approximately parallel with the pull-out direction A, a storage case roller 42*a* which is rotatably supported to the storage case rail body 41*a* and a storage case stopper 43*a* which is an engaging portion. The storage case roller 42*a* is rotatably supported to the storage case rail body 41*a* at a trailing end of the pull-out direction A (hereinafter, simply referred to as "trailing end") to assist a movement of the pull-out direction A of the storage case body 34. The storage case stopper 43*a* is formed in a convex shape that projects upward at the trailing end of the pull-out direction A of the storage case rail body 41*a*.

As illustrated in FIG. 4, the feeding apparatus body 32 includes a storage case frame 37 formed to store the storage case 31 and a pair of frame rails 5*a* and 5*b* which configure the drop-out preventing unit for guiding the storage case 31 to the pull-out direction from the storage case frame 37.

The storage case frame 37 is formed in an approximately rectangular box shape having an opening 37*a* at the leading end, a bottom portion of the opening 37*a* being penetrated, and the storage case 31 is stored in the opening 37*a*. In addition, four casters 38*a*, 38*b*, 38*c*, and 38*d* are attached to a bottom of the storage case frame 37 and four casters 38*a*, 38*b*, 38*c*, and 38*d* can be fixed after the image forming apparatus 1 is moved toward a given position.

The pair of frame rails 5*a* and 5*b* is symmetrically installed on both inner walls inside the opening 37*a* of the storage case frame 37 perpendicular to the pull-out direction A so as to be approximately parallel with the pull-out direction A. Moreover, since the frame rail 5*a* and the frame rail 5*b* have the same configuration, the frame rail 5*a* installed on one inner wall of the storage case frame 37 is described and the frame rail 5*b* will not be described as denoted by "b" instead of a tag "a".

The frame rail 5*a* includes a lower-face rail portion 51*a* which is located below the storage case rail 4*a* when the storage case 31 is stored in the storage case frame 37 and an upper-face rail portion 52*a* which is a guiding portion for guiding the storage case stopper 43*a* above the storage case rail 4*a*.

As illustrated in FIG. 5, the lower-face rail portion 51*a* is approximately parallel with the pull-out direction of the storage case 31 and formed on a height level in which the storage case caster 36 of the storage case 31 is separated from the floor FL when the storage case 31 is stored in the storage case frame 37. In addition, the lower-face rail portion 51*a* includes a rail roller 53*a* which is rotatably supported at the leading end, and the rail roller 53*a* movably supports the storage case rail body 41*a* in the pull-out direction A. That is, the storage case rail body 41*a* is movably supported by the rail roller 53*a* and the above-described storage case roller 42*a* in the pull-out direction A. Namely, the storage case body 34 is movably supported by the rail rollers 53*a* and 53*b* and the storage case rollers 42*a* and 42*b* in the pull-out direction A.

The upper-face rail portion 52*a* is approximately parallel with the pull-out direction of the storage case 31 and formed on a position which is separated with a predetermined interval from the lower-face rail portion 51*a* so that the storage case rail 4*a* is movable in the pull-out direction A when the storage case 31 is stored in the storage case frame 37. In addition, the above predetermined interval represents an interval in which the storage case rail 4*a* can be inclined (for example, see FIG. 9 below).

Further, the upper-face rail portion 52*a* includes a pull-out stopper 54*a* which is a first stopper and a drop-out stopper 55*a* which is a second stopper formed at a rear end of the pull-out direction from the pull-out stopper 54*a*. The pull-out stopper 54*a* is formed at a pull-out regulating position of the leading end of the upper-face rail portion 52*a*. In addition, the pull-out stopper 54*a* is formed in a projection shape projecting downward from a guide surface of the upper-face rail portion 52*a* so as to engage with the storage case stopper 43*a* when the storage case rail 4*a* moves in a state where a rotation angle of the storage case rail 4*a* is not rotated (inclined) more than a predetermined angle. The rotation angle represents an angle in which the storage case rail 4*a* is inclined from a horizontal direction. The drop-out stopper 55*a* is formed at a drop-out preventing position of the upper-face rail portion 52*a*. In addition, the drop-out stopper 55*a* is formed in the projection shape projecting downward from the guide surface of the upper-face rail portion 52*a* so as to engage with the storage case stopper 43*a* when the storage case rail 4*a* moves in a state in which the storage case rail 4*a* is rotated more than a predetermined angle. Moreover, the drop-out preventing position represents a position in which the horizontal distance from a rotating fulcrum (positions of rail rollers 53*a* and 53*b*) of the storage case 31 is longer than the horizontal distance from the rotating fulcrum to the center of the storage case 31 when the storage case 31 is rotated downward with a predetermined angle or more at the time of pulling out the storage case 31. This will be described in detail below with reference to FIG. 10. In addition, the drop-out preventing position represents a position that is accessible to the sheet stored in the storage case 31 from outside.

Next, the pull-out operation at the time of pulling out the storage case 31 from the feeding apparatus body 32 will be described with reference to FIGS. 6 to 12.

Figure 6B:
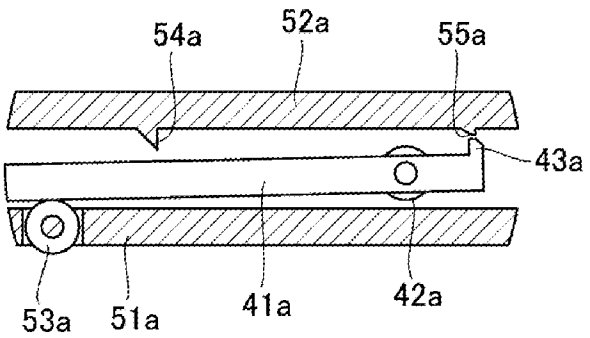
FIGS. 6A and 6B are cross-sectional views illustrating a state where the storage case is pulled out from the feeding apparatus body in a state where a storage case caster comes in contact with a floor.
Figure 6A:
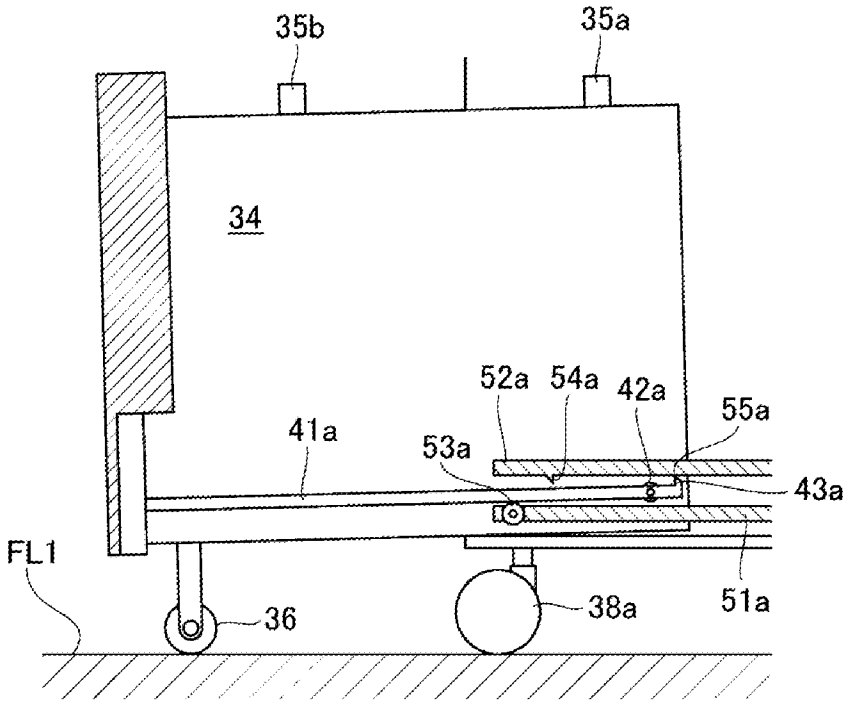
Figure 7:
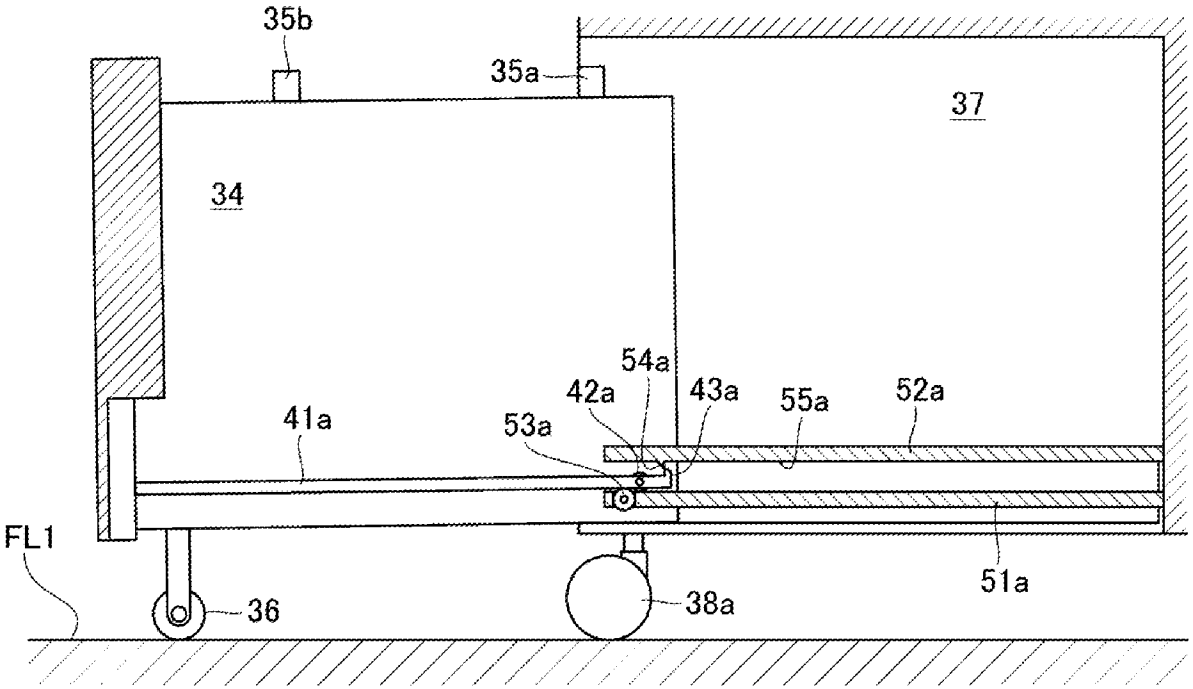
FIG. 7 is a cross-sectional view illustrating a state where the storage case is pulled out from the feeding apparatus body in a state where the storage case caster comes in contact with the floor.

First, with respect to the pull-out operation of the storage case 31 in case of installing the image forming apparatus 1 on the flat floor FL, it will be described with reference to FIGS. 6A, 6B, and 7. FIGS. 6A and 6B are cross-sectional views illustrating a state where the storage case 31 is pulled out from the feeding apparatus body 32 in a state where a storage case caster 36 comes in contact with the floor FL. FIG. 7 is a cross-sectional view illustrating a state where the storage case 31 is pulled out from the feeding apparatus body 32 in a state where the storage case caster 36 comes in contact with the floor FL.

As illustrated in FIGS. 6A and 6B, in a case where the image forming apparatus 1 is installed on the flat floor FL, when the storage case 31 is pulled out from the feeding apparatus body 32, the storage case caster 36 comes in contact with the floor FL, first. In a case where the storage case caster 36 comes in contact with the floor FL, the storage case caster 36 assists the movement of the storage case body 34 while supporting the weight of the storage case body 34 at the leading end. Accordingly, the storage case 31 is not rotated downward (floor side) with a predetermined angle or more. For this reason, the storage case rails 4*a* and 4*b* are not also inclined at the predetermined angle or more and the drop-out stoppers 55*a* and 55*b* are not engaged with the storage case stoppers 43*a* and 43*b*, respectively. As a result, the movement of the storage case 31 is not regulated at the drop-out preventing position, and as illustrated in FIG. 7, the storage case 31 is movable to the pull-out regulating position at which the pull-out stoppers 54*a* and 54*b* and the storage case stoppers 43*a* and 43*b* are engaged with each other.

Figure 8:
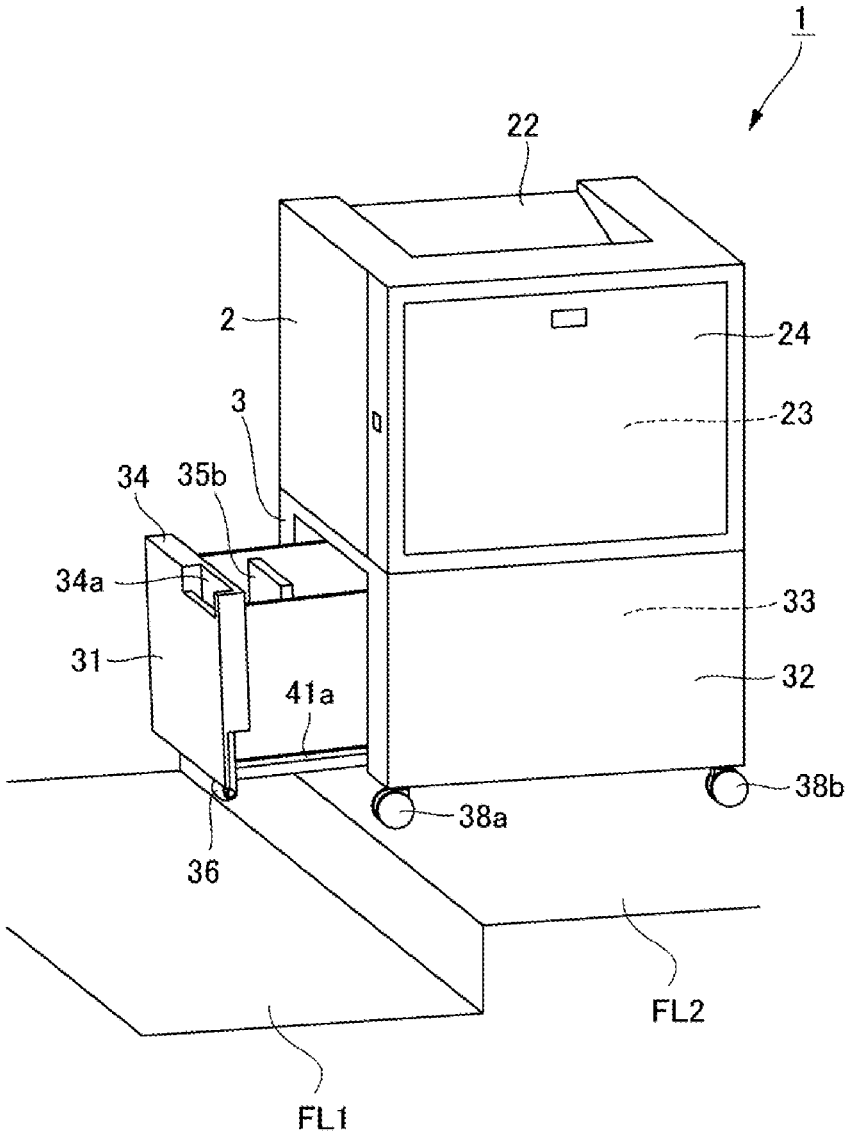
FIG. 8 is a perspective view illustrating a state where the storage case is pulled out from the sheet feeding apparatus of the image forming apparatus installed on an upper-step side of a stepped floor.
Figure 9:
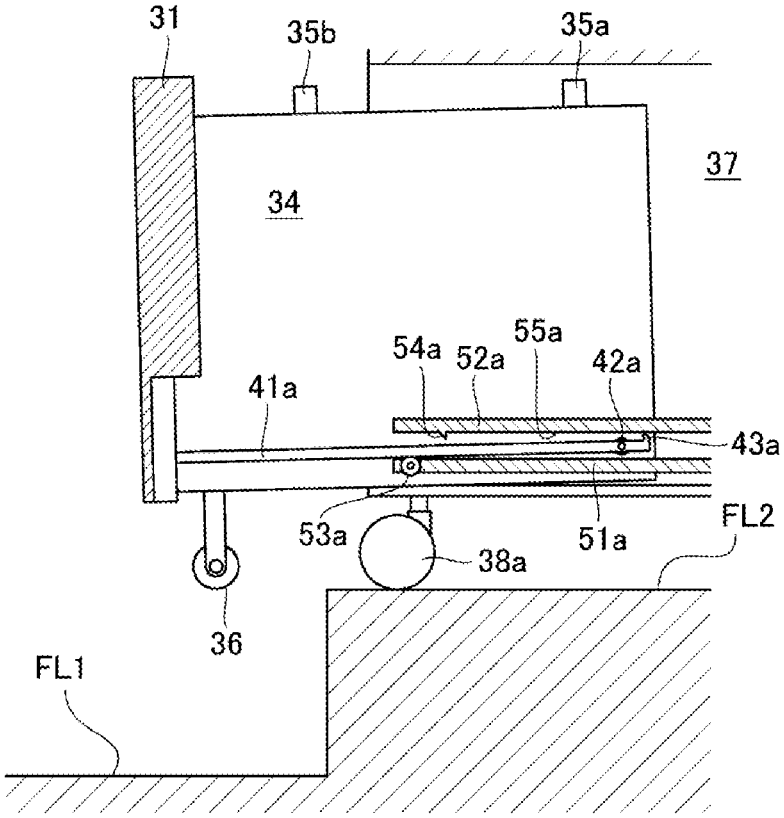
FIG. 9 is a cross-sectional view illustrating a state where the storage case is pulled out from the sheet feeding apparatus of the image forming apparatus installed on the upper-step side of the stepped floor.
Figure 10:
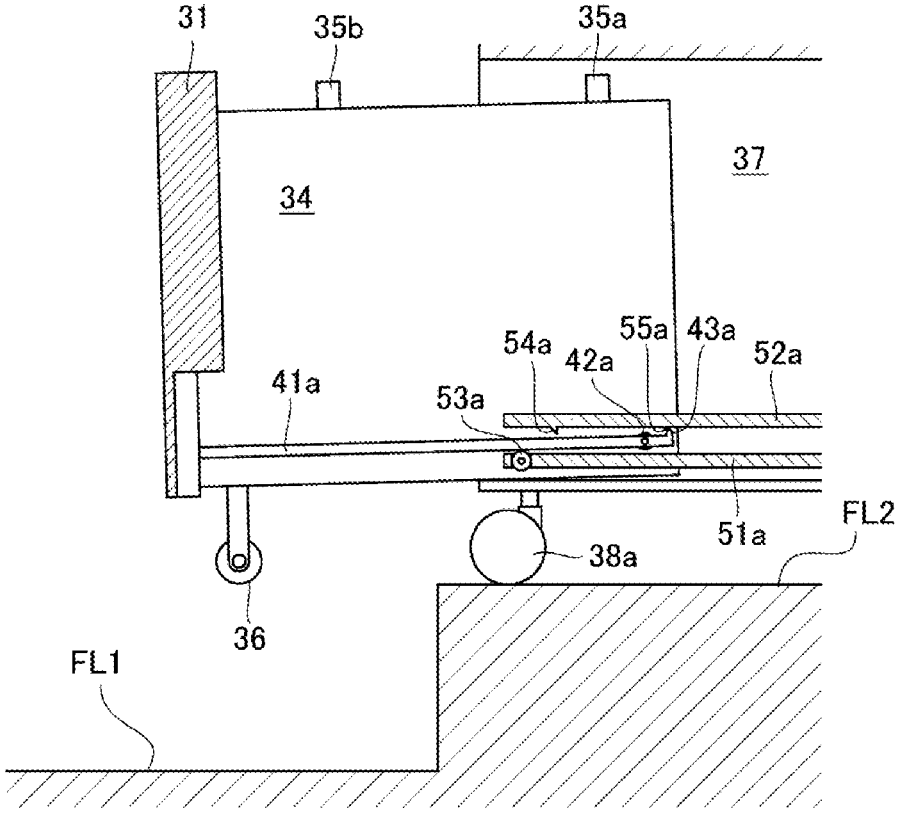
FIG. 10 is a cross-sectional view illustrating a state where the storage case pulled out from the sheet feeding apparatus of the image forming apparatus installed on the upper-step side of the stepped floor is stopped by a drop-out stopper.
Figure 11:
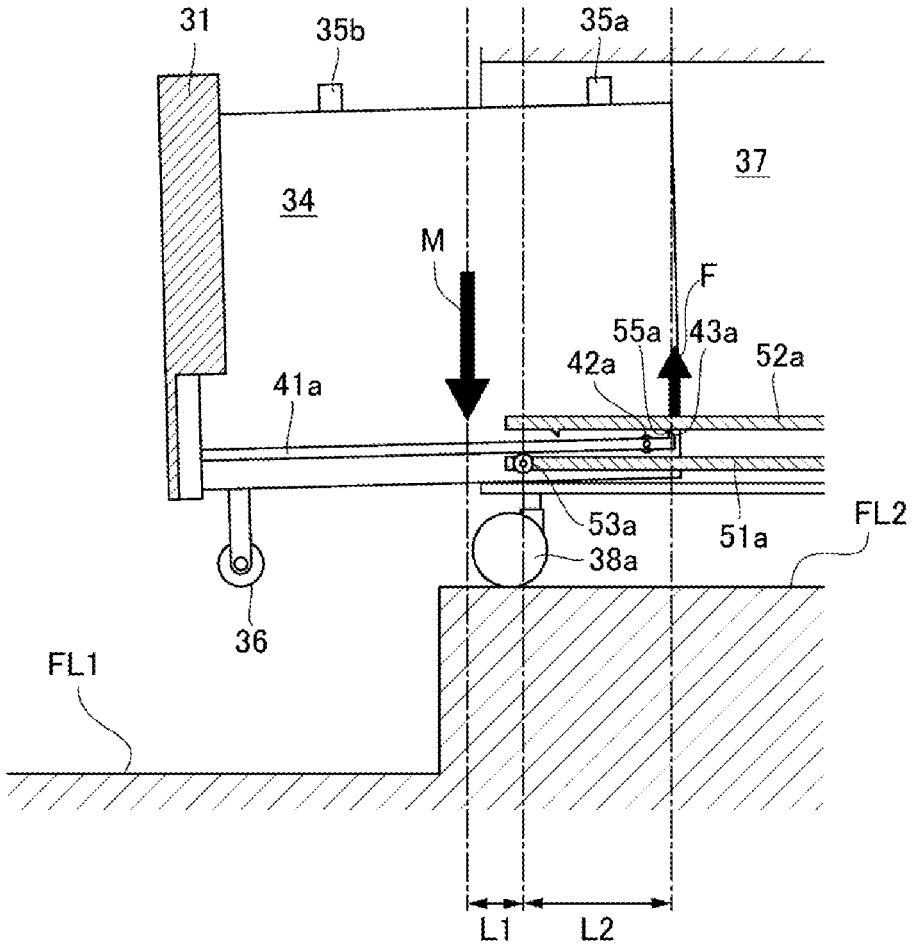
FIG. 11 is a cross-sectional view illustrating moment of the storage case at the state illustrated in FIG. 10.
Figure 12:
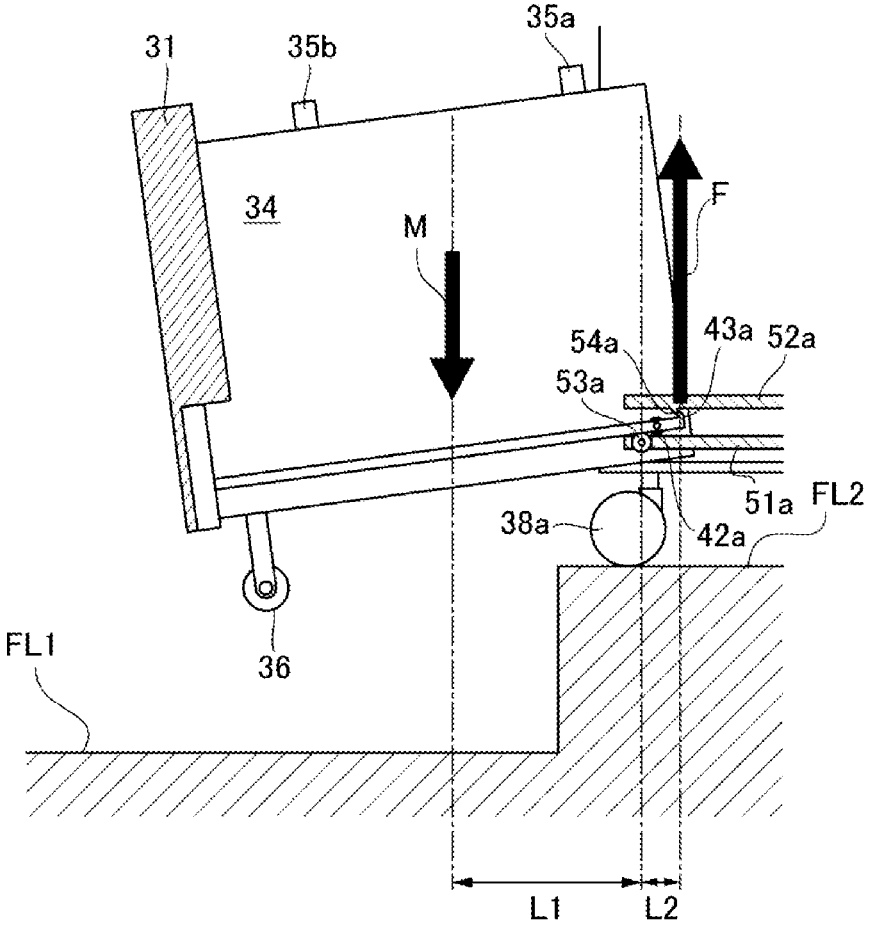
FIG. 12 is a cross-sectional view illustrating moment of the storage case at a state where the storage case pulled out from the sheet feeding apparatus of the image forming apparatus installed on the upper-step side of the stepped floor is stopped by a pull-out stopper.

Subsequently, with respect to the pull-out operation of the storage case 31 in case of installing the image forming apparatus 1 on an upper-step floor FL2 of the stepped floor, it will be described with reference to FIGS. 8 to 12. FIG. 8 is a perspective view illustrating a state where the storage case 31 is pulled out from the sheet feeding apparatus 3 of the image forming apparatus 1 installed on the upper-step floor FL2 of the stepped floor. FIG. 9 is a cross-sectional view illustrating a state where the storage case 31 is pulled out from the sheet feeding apparatus 3 of the image forming apparatus 1 installed on the upper-step floor FL2 of the stepped floor. FIG. 10 is a cross-sectional view illustrating a state where the storage case 31 pulled out from the sheet feeding apparatus 3 of the image forming apparatus 1 installed on the upper-step floor FL2 of the stepped floor is stopped by drop-out stoppers 55*a* and 55*b*. FIG. 11 is a cross-sectional view illustrating moment of the storage case 31 in the state illustrated in FIG. 10. FIG. 12 is a cross-sectional view illustrating moment of the storage case 31 in a state where the storage case 31 pulled out from the sheet feeding apparatus 3 of the image forming apparatus 1 installed on the upper-step floor FL2 of the stepped floor is stopped by pull-out stoppers 54*a* and 54*b*.

As illustrated in FIG. 8, in a case where the image forming apparatus 1 is installed on the upper-step floor FL2 of the stepped floor, when the storage case 31 is pulled out from the feeding apparatus body 32, the storage case caster 36 comes in not contact with the floor FL in a state of floating in the air. Accordingly, as illustrated in FIG. 9, the storage case 31 is rotated downward (floor side) with the predetermined angle or more. For this reason, the storage case rails 4*a* and 4*b* are inclined at the predetermined angle or more and the storage case stoppers 43*a* and 43*b* formed at the trailing end of the storage case rail bodies 41*a* and 41*b* abut onto the upper-face rail portions 52*a* and 52*b*.

In this state, when the storage case 31 is additionally pulled out, the storage case stoppers 43*a* and 43*b* are guided while sliding to the upper-face rail portions 52*a* and 52*b* to move in the pull-out direction A. Further, as illustrated in FIG. 10, when the drop-out stoppers 55*a* and 55*b* and the storage case stoppers 43*a* and 43*b* are engaged with each other in the middle of guiding, the movement of the storage case 31 is regulated.

At this time, as illustrated in FIG. 11, self weight G of the storage case 31 is supported at the drop-out preventing position of the upper-face rail portions 52*a* and 52*b* using the rail rollers 53*a* and 53*b* as a rotating fulcrum. Assuming that "M" represents a force at the weighted center of the storage case 31, "L1" represents the horizontal distance between the weighted center and the rail rollers 53*a* and 53*b*, and "L2" represents the horizontal distance between the rail rollers 53*a* and 53*b* and the drop-out preventing position, the force F concerning the drop-out preventing position of the upper-face rail portions 52*a* and 52*b* is expressed as $F=G\times L1/L2$. For example, if the value of G, L1, and L2 is 10 kg, 40 cm, and 120 cm, respectively, and then the value of F is 3.3 kg.

Meanwhile, if there are no the drop-out stoppers 55*a* and 55*b* on the upper-face rail portion 52*a*, as illustrated in FIG. 12, when the pull-out stoppers 54*a* and 54*b* and the storage case stoppers 43*a* and 43*b* are engaged with each other at the pull-out regulating position, the movement of the storage case 31 is regulated. In this case, for example, if the value of G, L1, and L2 is 10 kg, 140 cm, and 30 cm, respectively, and then the value of F is 46.7 kg.

Thus, it is possible to drastically reduce the load onto the upper-face rail portions 52*a* and 52*b* and the storage case stoppers 43*a* and 43*b* by regulating ahead the pull-out of the storage case 31 due to the drop-out stoppers 55*a* and 55*b*. For this reason, since an excessive moment is applied to the interlocked portion of the feeding apparatus body and the storage case, it is possible to prevent the deformation and breakage of the rail from being generated.

Moreover, it can prevent the increase in cost with a simple configuration for engaging the drop-out stoppers 55*a* and 55*b* and the storage case stoppers 43*a* and 43*b* with each other.

Second Embodiment

Next, an image forming apparatus 1A according to a second embodiment of the present invention will be described with reference to FIGS. 13 to 20. The image forming apparatus 1A according to the second embodiment differs from the first embodiment in terms of a sheet feeding apparatus. In the second embodiment, accordingly, it will mainly describe the sheet feeding apparatus different from that of the first embodiment, and configurations similar to those of the first embodiment are denoted by the same reference numerals and will not be repeatedly described.

Figure 13:
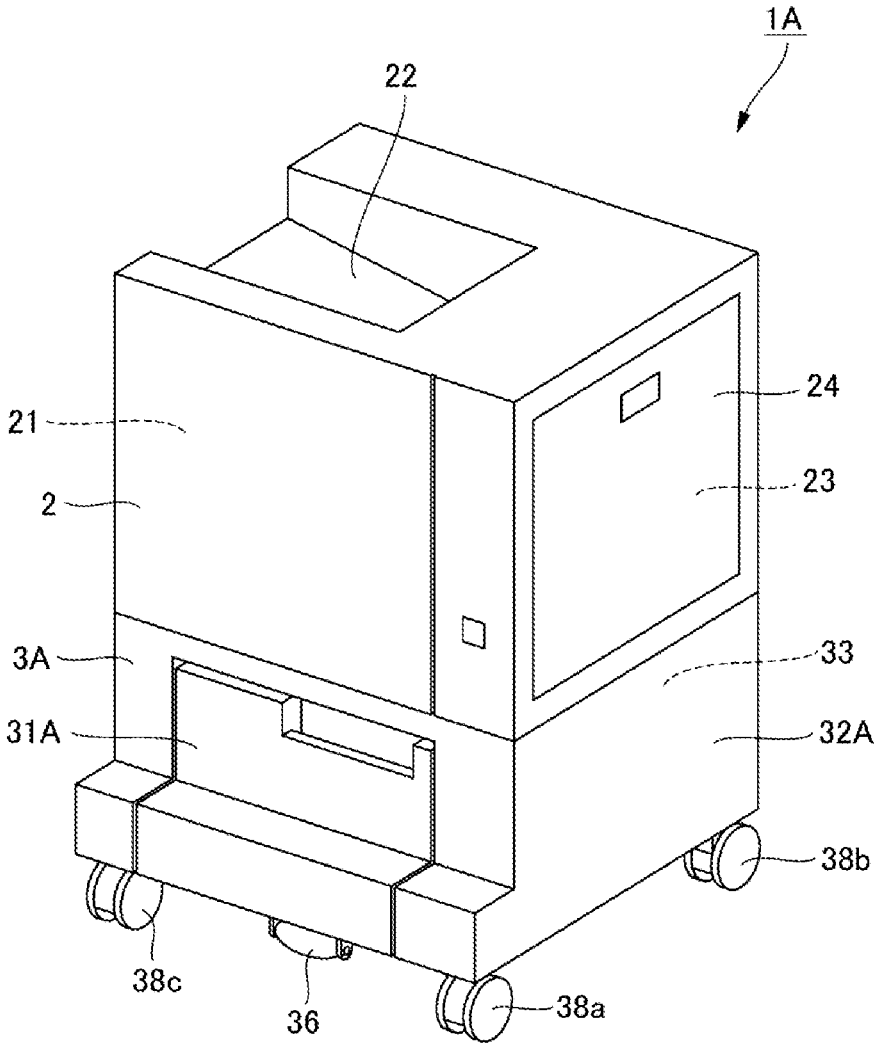
FIG. 13 is a perspective view illustrating an overall configuration of an image forming apparatus according to a second embodiment of the present invention.
Figure 14:
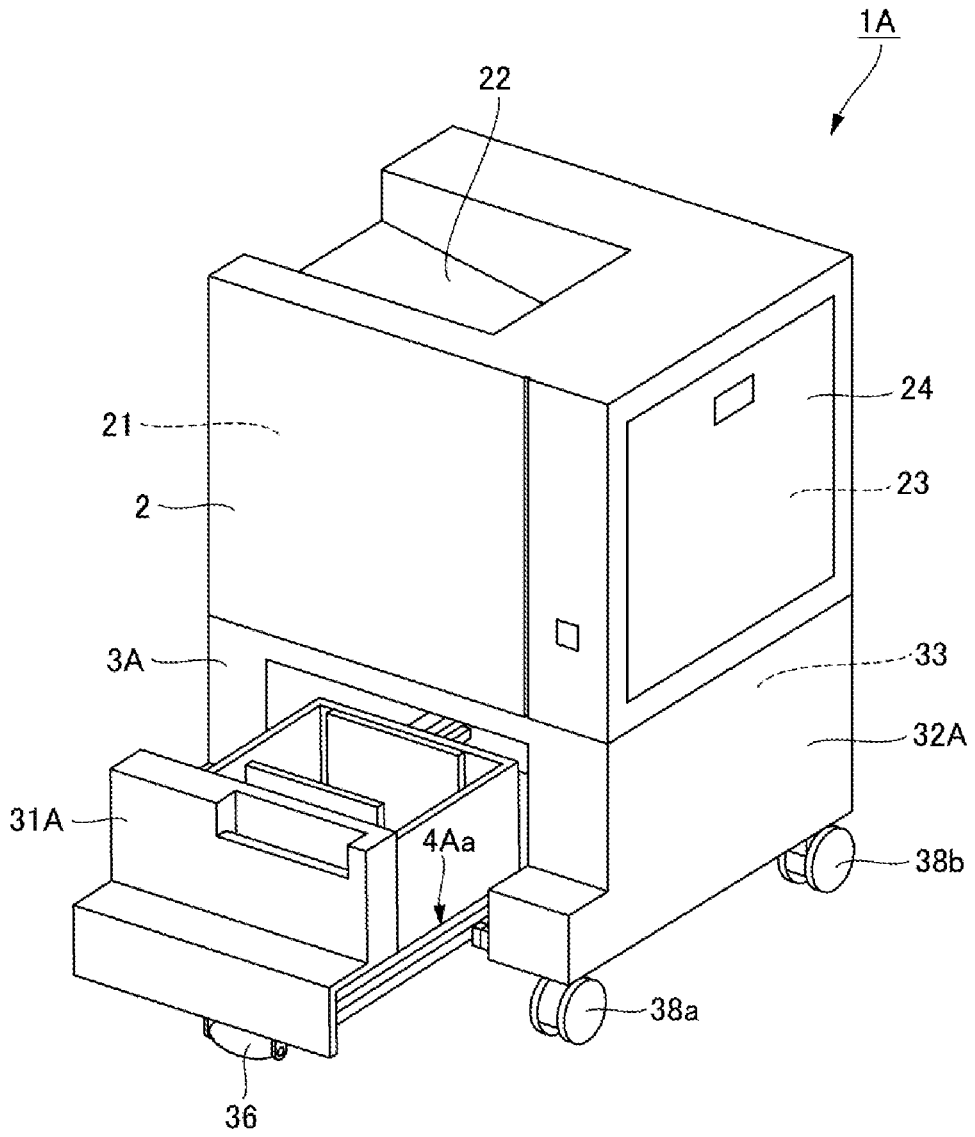
FIG. 14 is a perspective view illustrating a state where a storage case is pulled out from a feeding apparatus body of a sheet feeding apparatus according to the second embodiment.
Figure 15:
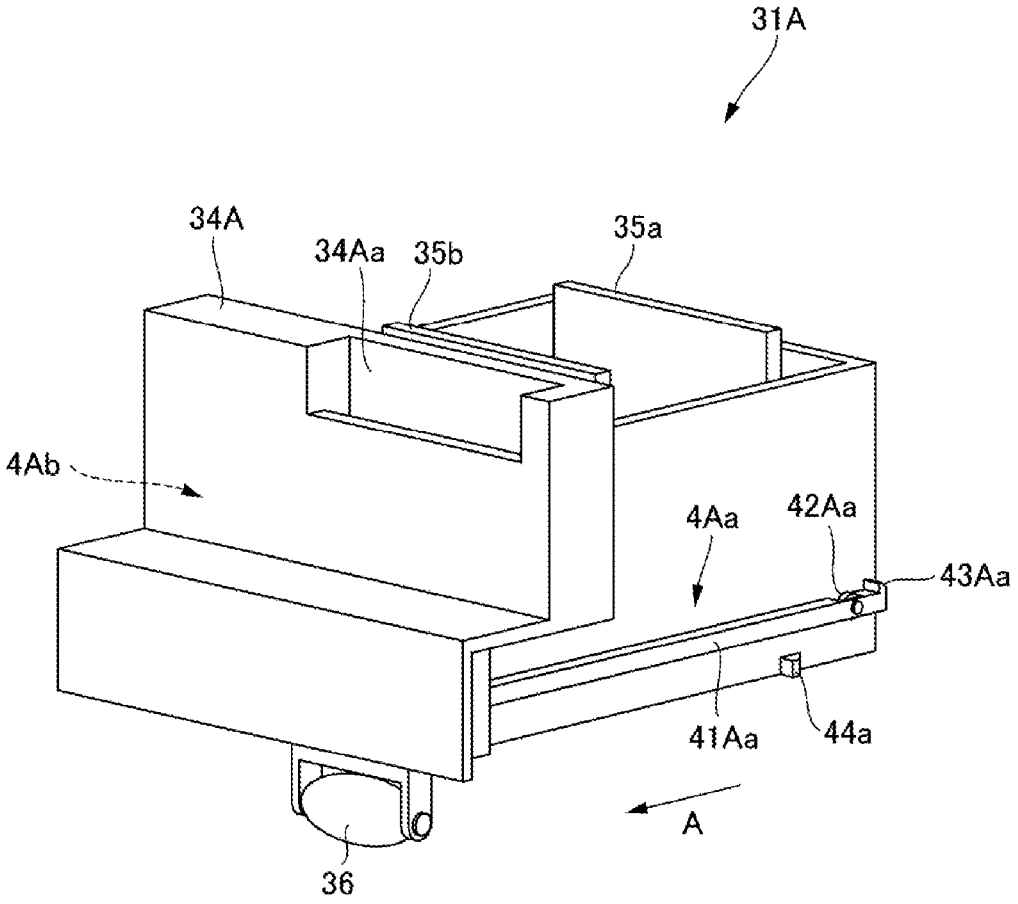
FIG. 15 is a perspective view illustrating the storage case of the sheet feeding apparatus according to the second embodiment.
Figure 16:
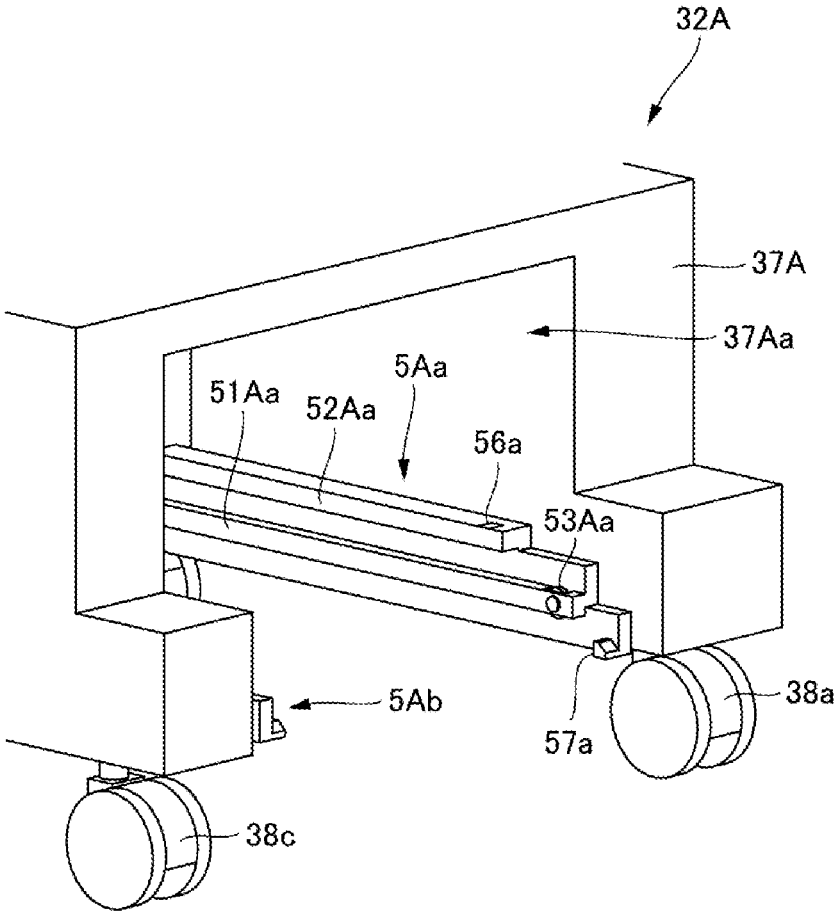
FIG. 16 is a perspective view illustrating the feeding apparatus body of the sheet feeding apparatus according to the second embodiment.
Figure 17:
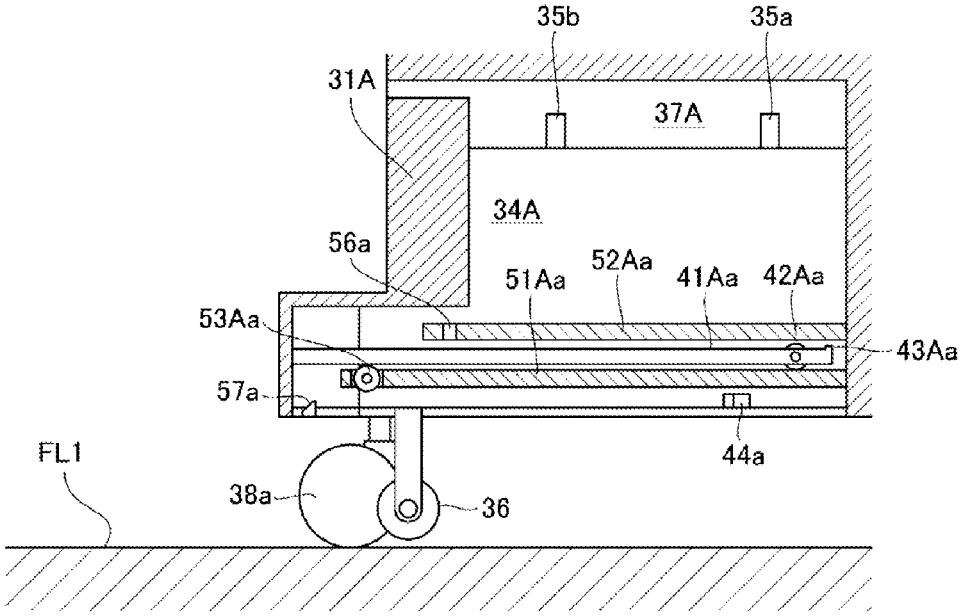
FIG. 17 is a cross-sectional view illustrating a state where the storage case is stored in the feeding apparatus body.

First, with regard to an overall configuration of the image forming apparatus 1A according to the second embodiment, it will be described with reference to FIGS. 13 to 17. FIG. 13 is a perspective view illustrating the overall configuration of the image forming apparatus 1A according to the second embodiment of the present invention. FIG. 14 is a perspective view illustrating a state where a storage case 31A is pulled out from a feeding apparatus body 32A of a sheet feeding apparatus 3A according to the second embodiment. FIG. 15 is a perspective view illustrating the storage case 31A of the sheet feeding apparatus 3A according to the second embodiment. FIG. 16 is a perspective view illustrating the feeding apparatus body 32A of the sheet feeding apparatus 3A according to the second embodiment. FIG. 17 is a cross-sectional view illustrating a state where the storage case 31A is stored in the feeding apparatus body 32A.

As illustrated in FIGS. 13 and 14, the image forming apparatus 1A includes an image forming apparatus body 2 which forms an image on a sheet and a sheet feeding apparatus 3A which feeds the sheet into the image forming apparatus body 2.

The sheet feeding apparatus 3A includes a storage case 31A which stores the sheet, a feeding apparatus body 32A which stores the storage case 31 to be freely pulled out, and a feeding unit 33 which feeds the sheet stored in the storage case 31 toward the image forming portion 21.

As illustrated in FIG. 15, the storage case 31A includes a storage case body 34A, a pair of aligning members 35*a* and 35*b*, a storage case caster 36, and a pair of storage case rails 4Aa and 4Ab which are serving as a drop-out preventing unit provided at both lateral faces of the storage case body 34. In addition, the storage case 31A includes a pull-out regulating engaging portion 44*a* which is serving as a pull-out regulating unit.

The storage case body 34A, which is formed such that the sheet can be stored with the stacked state, includes a gripping portion 34Aa provided at a leading end on which a user grips at the time of pulling out the storage case 31A. The storage case caster 36 is provided on the bottom of the leading end of the storage case body 34A to support a weight of the storage case body 34A at the leading end by coming in contact with a floor FL and to assist the movement of the storage case body 34A when the storage case body 34A is pulled out by the user.

The pair of storage case rails 4Aa and 4Ab is symmetrically installed on both lateral faces perpendicular to the pull-out direction A of the storage case body 34A so as to be approximately parallel with the pull-out direction A. Moreover, since the storage case rail 4Aa and the storage case rail 4Ab have the same configuration, the storage case rail 4Aa installed on one lateral face of the storage case body 34A is described and the storage case rail 4Ab will not be described as denoted by "b" instead of a tag "a".

The storage case rail 4Aa includes a storage case rail body 41Aa which extends approximately parallel with the pull-out direction A, a storage case roller 42Aa which is rotatably supported to the storage case rail body 41Aa and a storage case stopper 43Aa which is an engaging portion. The storage case roller 42Aa is rotatably supported to the storage case rail body 41Aa at a trailing end to assist the movement of the pull-out direction A of the storage case body 34A. The storage case stopper 43Aa is formed in a convex shape that projects upward at the trailing end of the storage case rail body 41Aa.

As illustrated in FIG. 16, the feeding apparatus body 32A includes a storage case frame 37A formed to store the storage case 31A and a pair of frame rails 5Aa and 5Ab which configure the drop-out preventing unit for guiding the storage case 31A to the pull-out direction. In addition, the feeding apparatus body 32A includes a pull-out regulating engaged portion 57*a* which is engaged with the pull-out regulating engaging portion 44*a* of the storage case 31A at the time of pulling out the storage case 31A. The storage case frame 37A is formed in an approximately rectangular box shape having an opening 37Aa at the leading end, a bottom portion of the opening 37Aa being penetrated, and the storage case 31A is stored in the opening 37Aa. In addition, four casters 38*a*, 38*b*, 38*c*, and 38*d* are attached to a bottom of the storage case frame 37A.

The pair of frame rails 5Aa and 5Ab is symmetrically installed on both inner walls inside the opening 37Aa of the storage case frame 37A perpendicular to the pull-out direction A so as to be approximately parallel with the pull-out direction A. Moreover, since the frame rail 5Aa and the frame rail 5Ab have the same configuration, the frame rail 5Aa installed on one inner wall of the storage case frame 37A is described and the frame rail 5Ab will not be described as denoted by "b" instead of a tag "a".

The frame rail 5Aa includes a lower-face rail portion 51Aa which is located below the storage case rail 4Aa when the storage case 31A is stored therein and an upper-face rail portion 52Aa which is a guiding portion for guiding the storage case stopper 43Aa above the storage case rail 4Aa.

As illustrated in FIG. 17, the lower-face rail portion 51Aa is approximately parallel with the pull-out direction of the storage case 31A and formed on a height level in which the storage case caster 36 of the storage case 31A is separated from the floor FL when the storage case 31A is stored in the storage case frame 37A. In addition, the lower-face rail portion 51Aa includes a rail roller 53Aa which is rotatably supported at the leading end, and the rail roller 53Aa movably supports the storage case rail body 41Aa in the pull-out direction A. That is, the storage case rail body 41Aa is movably supported by the rail roller 53Aa and the above-described storage case roller 42Aa in the pull-out direction A. Rather, the storage case body 34A is movably supported by the rail roller 53Aa and 53Ab and the storage case roller 42Aa and 42Ab in the pull-out direction A.

The upper-face rail portion 52Aa is approximately parallel with the pull-out direction of the storage case 31A and provided on a position which is separated with a predetermined interval from the lower-face rail portion 51Aa so that the storage case rail 4Aa is movable in the pull-out direction A when the storage case 31A is stored in the storage case frame 37A. In addition, the above predetermined interval represents an interval in which the storage case rail body 41Aa can be inclined. Further, the upper-face rail portion 52Aa includes a drop-out preventing hole 56*a* which is a second stopper, and the drop-out preventing hole 56*a* is provided at a drop-out preventing position of the trailing end compared with the pull-out regulating engaged portion 57*a*. Moreover, the drop-out preventing position represents a position in which the image forming apparatus 1A does not fall down even when the storage case 31A stacked with a large quantity of sheets is pulled out and represents a position that is accessible to the sheet stored in the storage case 31A from the outside.

Figure 18:
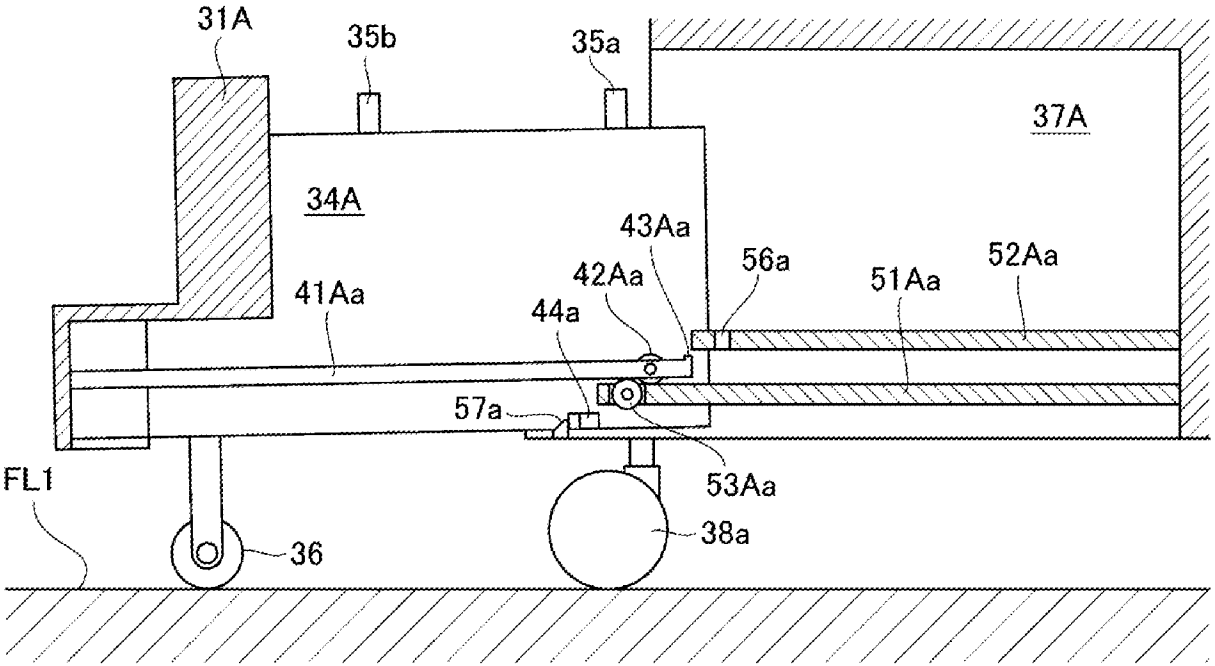
FIG. 18 is a cross-sectional view illustrating a state where the storage case is pulled out from the feeding apparatus body in a state where a storage case caster comes in contact with a floor.

Next, the pull-out operation at the time of pulling out the storage case 31A from the feeding apparatus body 32A will be described with reference to FIGS. 18 to 20. First, with respect to the pull-out operation of the storage case 31A in case of installing the image forming apparatus 1A on the flat floor FL, it will be described with reference to FIG. 18. FIG. 18 is a cross-sectional view illustrating a state where the storage case 31A is pulled out from the feeding apparatus body 32A in a state where the storage case caster 36 comes in contact with the floor FL.

As illustrated in FIG. 18, in a case where the image forming apparatus 1A is installed on the flat floor FL, when the storage case 31A is pulled out from the feeding apparatus body 32A, the storage case caster 36 comes in contact with the floor FL, first. In a case where the storage case caster 36 comes in contact with the floor FL, the storage case caster 36 assists the movement of the storage case body 34A while supporting the weight of the storage case body 34A at the leading end. Accordingly, the storage case 31A is not rotated downward (floor side) with a predetermined angle or more. For this reason, the storage case rails 4Aa and 4Ab are not also inclined at the predetermined angle or more, and the drop-out preventing holes 56*a* and 56*b* are not engaged with the storage case stoppers 43Aa and 43Ab, respectively. As a result, the movement of the storage case 31A is not regulated at the drop-out preventing position and is movable to the pull-out regulating position at which the pull-out regulating engaged portions 57*a* and 57*b* and the storage case stoppers 43Aa and 43Ab are engaged with each other.

Subsequently, with respect to the pull-out operation of the storage case 31A in case of installing the image forming apparatus 1A on an upper-step floor FL2 of a stepped floor, it will be described with reference to FIGS. 19 and 20. FIG. 19 is a perspective view illustrating a state where the storage case 31A is pulled out from the sheet feeding apparatus 3A of the image forming apparatus 1A installed on the upper-step floor FL2 of the stepped floor. FIG. 20 is a cross-sectional view illustrating a state where the storage case 31A pulled out from the sheet feeding apparatus 3A of the image forming apparatus 1A installed on the upper-step floor FL2 of the stepped floor is stopped by the pull-out regulating engaged portion 57*a*.

Figure 19:
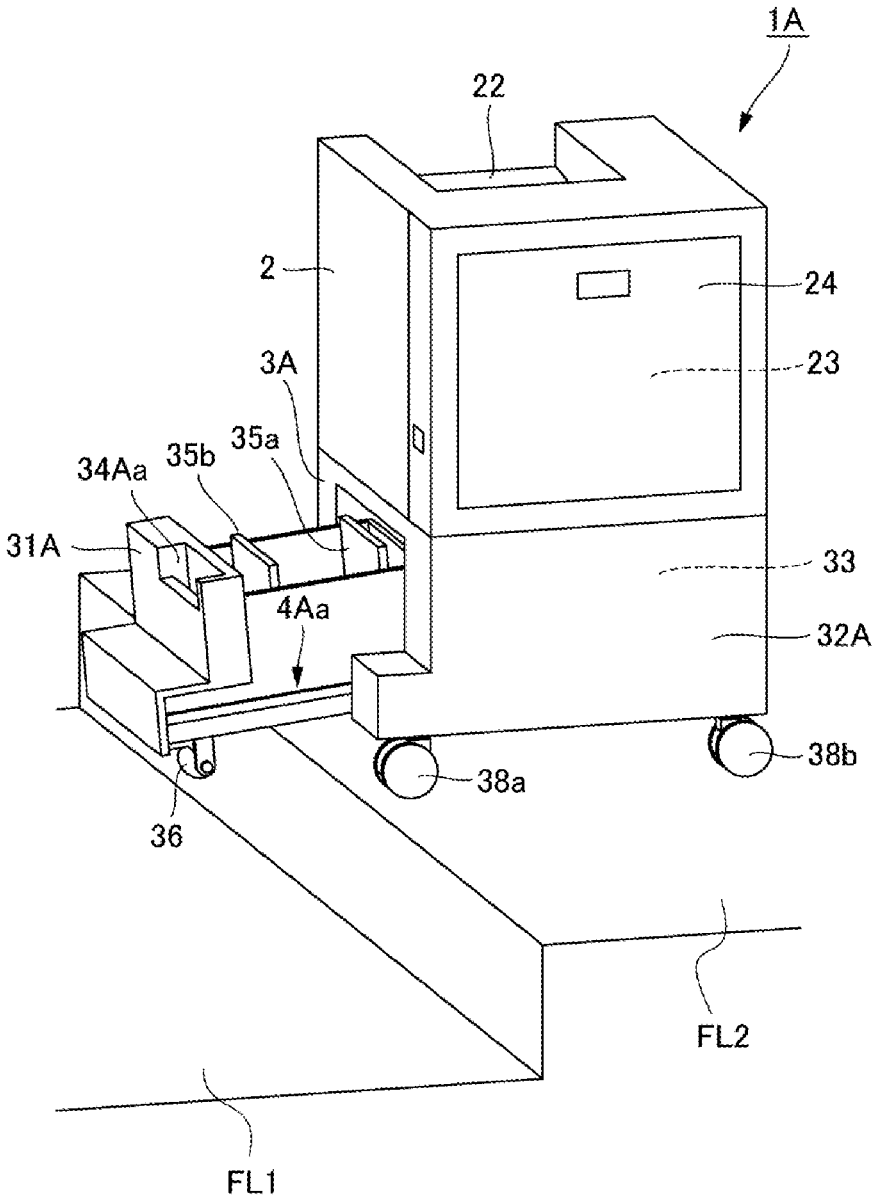
FIG. 19 is a perspective view illustrating a state where the storage case is pulled out from the sheet feeding apparatus of the image forming apparatus installed on the upper-step side of the stepped floor.
Figure 20:
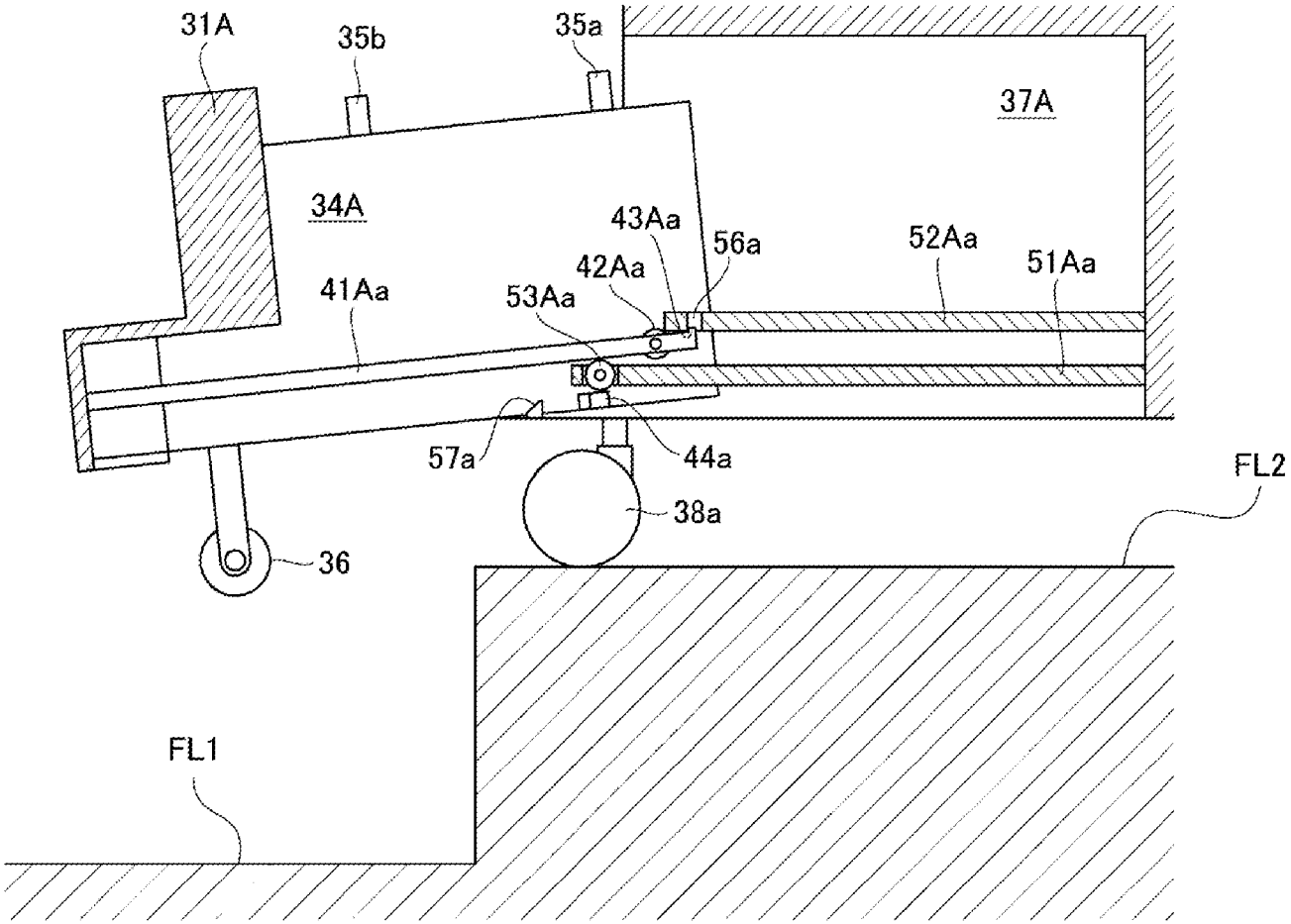
FIG. 20 is a cross-sectional view illustrating a state where the storage case pulled out from the sheet feeding apparatus of the image forming apparatus installed on the upper-step side of the stepped floor is stopped by a pull-out regulating engaged portion.

As illustrated in FIG. 19, in a case where the image forming apparatus 1A is installed on the upper-step floor FL2 of the stepped floor, when the storage case 31A is pulled out from the feeding apparatus body 32A, the storage case caster 36 comes in not contact with the floor FL in a state of floating in the air. Accordingly, as illustrated in FIG. 20, the storage case 31A is rotated downward (floor side) with the predetermined angle or more. For this reason, the storage case rails 4Aa and 4Ab are inclined at the predetermined angle or more, and the storage case stoppers 43Aa and 43Ab formed at the trailing end of the storage case rail bodies 41Aa and 41Ab abut onto the upper-face rail portions 52Aa and 52Ab.

In this state, when the storage case 31A is additionally pulled out, the storage case stoppers 43Aa and 43Ab are guided while sliding to the upper-face rail portions 52Aa and 52Ab to move in the pull-out direction A. Further, when the drop-out preventing holes 56*a* and 56*b* and the storage case stoppers 43Aa and 43Ab are engaged with each other in the middle of guiding, the movement of the storage case 31A is regulated.

Thus, it is possible to reduce the load onto the upper-face rail portions 52Aa and 52Ab and the storage case stoppers 43Aa and 43Ab by regulating ahead the pull-out of the storage case 31A due to the drop-out preventing holes 56*a* and 56*b* and the storage case stoppers 43Aa and 43Ab.

The foregoing has been described exemplary embodiments of the present invention, but the present invention is not limited to the embodiments described above. Further, the effects described in the exemplary embodiment of the present invention merely enumerate the most preferable effects resulting from the present invention, and the effects according to the present invention is not limited to those described in the exemplary embodiment of the present invention.

For example, the storage case caster serving as the rotating supporting member is described in the present embodiments, but the invention is not limited thereto. The rotating supporting member may be the rotating member such as a roller.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-159459, filed Jul. 18, 2012, which is hereby incorporated by reference herein in its entirety.

What is claimed is:

1. A sheet feeding apparatus, comprising:

an apparatus body;

a sheet storage case configured for pulling out from the apparatus body;

a rotating supporting member which is provided in the sheet storage case to support the sheet storage case for movement in a pull-out direction by contacting with a lower support surface while the sheet storage case is pulled out from the apparatus body;

an engaging portion which is provided at a rear side in the pull-out direction of the sheet storage case;

a guiding portion which is provided in the apparatus body to guide the engaging portion in the pull-out direction;

a first stopper provided on said guiding portion, which is engageable with the engaging portion to regulate a pull-out of the sheet storage case from the apparatus body when the sheet storage case is moved in the pull-out direction; and a second stopper provided at the rear side of said guiding portion in the pull-out direction relative to the first stopper and at a front side in the pull-out direction from a position of the engaging portion when a rotation of the sheet storage case by its own weight is started while pulling out of the sheet storage case, and is engageable with the engaging portion to regulate a movement in the pull-out direction of the sheet storage case, wherein in a case that the sheet storage case is rotated downward at an angle less than a predetermined angle in the middle of pulling out of the sheet storage case while the rotating supporting member contacts with the lower support surface to support the sheet storage case, the second stopper is not engaged with the engaging portion and the first stopper is engaged with the engaging portion, and in a case that the sheet storage case is rotated downward at least at the predetermined angle, the second stopper is engaged with the engaging portion to regulate a pull-out of the sheet storage case.

2. The sheet feeding apparatus according to claim 1, wherein, in a case where the rotating angle of the sheet storage case is less than the predetermined angle, the pull-out of the sheet storage case is regulated by engaging the engaging portion with the first stopper.

3. The sheet feeding apparatus according to claim 1, wherein the second stopper is provided at a position in which a horizontal distance from a rotating fulcrum of the sheet storage case is longer than a horizontal distance from the rotating fulcrum to a weighted center of the sheet storage case when the sheet storage case is rotated downward.

4. The sheet feeding apparatus according to claim 3, wherein the position in which the pulling out of the sheet storage case is regulated by engaging the engaging portion with the second stopper is a position which is accessible to a sheet stored in the sheet storage case from outside.

5. The sheet feeding apparatus according to claim 1, wherein the engaging portion is formed in a convex shape projected toward the guiding portion, and the second stopper is formed in a projection shape projected from the guiding portion so as to engage with the convex-shaped engaging portion when the sheet storage case is rotated with the predetermined angle or more.

6. The sheet feeding apparatus according to claim 1, wherein the engaging portion is formed in a convex shape projected toward the guiding portion, and the second stopper is formed in a hole shape at the guiding portion so as to engage with the convex-shaped engaging portion when the sheet storage case is rotated with the predetermined angle or more.

7. An image forming apparatus, comprising:

a sheet feeding apparatus according to claim 1; and an image forming portion which forms an image on a sheet fed by the sheet feeding apparatus.

8. The sheet feeding apparatus according to claim 1, wherein, in a case that the sheet storage case is rotated downward with an angle less than the predetermined angle, the engaging portion is moved below the second stopper in the pull-out direction so as to not be engaged with the second stopper and so as to be engaged with the first stopper, and in a case that the sheet storage case is rotated downward with the predetermined angle or more, the engaging portion is moved with abutting to the guiding portion in the pull-out direction so as to be engaged with the second stopper.

9. A sheet feeding apparatus, comprising:

an apparatus body;

a sheet storage case which stores a sheet;

a rotating supporting member which is provided in the sheet storage case to support the sheet storage case for movement in a pull-out direction by contacting with a lower support surface while the sheet storage case is moving in the pull-out direction;

a rail body provided in the sheet storage case;

a rail which is provided in the apparatus body, said rail including an upper-face rail portion and a lower-face rail portion, and which guides the rail body between the upper-face rail portion and the lower-face rail portion to support the sheet storage case during pulling out from the apparatus body;

an engaging portion which is provided at a rear side of the rail body in the pull-out direction of the sheet storage case;

a first stopper provided at the upper-face rail portion of the rail, which is engagable with the engaging portion when the sheet storage case is in the middle of pulling out, to regulate a pull-out of the sheet storage case from the apparatus body; and a second stopper provided at the rear side of the upper-face rail portion in the pull-out direction relative to the first stopper and at a front side in the pull-out direction from a position of the engaging portion when a rotation of the sheet storage case by its own weight is started while pulling out of the sheet storage case, and is engageable with the engaging portion to regulate a movement in the pull-out direction of the sheet storage case, wherein in a case that the rotating supporting member holds the sheet storage case at an angle less than a predetermined angle when contacting with the lower support surface during pulling out of the sheet storage case, the second stopper is not engaged with the engaging portion and the first stopper is engaged with the engaging portion, and in a case that the sheet storage case is rotated downward at the predetermined angle or more, the second stopper is engaged with the engaging portion to regulate a pull-out of the sheet storage case.

10. The sheet feeding apparatus according to claim 9, wherein the sheet storage case moves in the pull-out direction while the engaging portion and the second stopper are not engaged with each other and the pull-out of the sheet storage case is regulated while the first stopper and the engaging portion are engaged with each other, in a state where the rotating supporting member comes in contact with the lower support surface when the sheet storage case is in the middle of pulling out.

11. The sheet feeding apparatus according to claim 9, wherein the second stopper is provided at a position in which a horizontal distance from a rotating fulcrum of the sheet storage case is longer than a horizontal distance from the rotating fulcrum to a weighted center of the sheet storage case when the sheet storage case is rotated.

12. The sheet feeding apparatus according to claim 11, wherein the position in which the pulling out of the sheet storage case is regulated by the second stopper is a position which is accessible to a sheet stored in the sheet storage case from outside.

13. The sheet feeding apparatus according to claim 9, wherein the engaging portion is formed in a convex shape projected toward the guiding portion, and the second stopper is formed in a projection shape projected from the guiding portion so as to engage with the convex-shaped engaging portion when the sheet storage case is rotated with the predetermined angle or more.

14. The sheet feeding apparatus according to claim 13, wherein the engaging portion is formed in a convex shape projected toward the guiding portion and the first stopper and the second stopper are formed in a projection shape projected from the guiding portion so as to be engageable with the engaging portion each other, and a project amount of the first stopper is higher than a project amount of the second stopper.

15. The sheet feeding apparatus according to claim 9, wherein the engaging portion is formed in a convex shape projected toward the guiding portion, and the second stopper is formed in a hole shape at the guiding portion so as to engage with the convex-shaped engaging portion when the sheet storage case is rotated with the predetermined angle or more.

16. An image forming apparatus, comprising:

a sheet feeding apparatus according to claim 9; and an image forming portion which forms an image on a sheet fed by the sheet feeding apparatus.

17. The sheet feeding apparatus according to claim 9, wherein, in a case that the sheet storage case is rotated downward with an angle less than the predetermined angle, the engaging portion is moved below the second stopper in the pull-out direction so as to not be engaged with the second stopper and so as to be engaged with the first stopper, and in a case that the sheet storage case is rotated downward with the predetermined angle or more, the engaging portion is moved with abutting to the upper-face rail portion in the pull-out direction so as to be engaged with the second stopper.

18. The sheet feeding apparatus according to claim 17, wherein the engaging portion is formed in a convex shape projected toward the upper-face rail portion and the first stopper and the second stopper are formed in a projection shape projected from the upper-face rail portion so as to be engageable with the engaging portion each other, and a project amount of the first stopper is higher than a project amount of the second stopper.

* * * * *